United States Patent [19]

Laski et al.

[11] 3,940,074

[45] Feb. 24, 1976

[54] DEVICE FOR DAMPING VIBRATIONS OF THE BOBBIN HOLDER

[75] Inventors: Jozef Laski; Jan Pacholski, both of Lodz, Poland

[73] Assignee: Centralne Biuro Techniczne Przemyslu Maszyn Wlokienniczych, Lodz, Poland

[22] Filed: Feb. 1, 1974

[21] Appl. No.: 438,713

[30] Foreign Application Priority Data

Feb. 7, 1973 Poland ..... 49914

[52] U.S. Cl. ..... 242/18 DD; 242/129.51

[51] Int. Cl.[2] ..... B65H 54/42; B65H 49/20

[58] Field of Search ..... 242/18 DD, 18 R, 129.51

[56] References Cited

UNITED STATES PATENTS

| | | | |
|---|---|---|---|
| 2,605,974 | 8/1952 | Keith | 242/18 DD |
| 2,651,479 | 9/1953 | Bauer | 242/129.51 |
| 3,181,804 | 5/1965 | Mullers et al. | 242/18 DD |
| 3,241,778 | 3/1966 | Bourgeas | 242/18 DD |

*Primary Examiner*—Stanley N. Gilreath
*Attorney, Agent, or Firm*—Edwin E. Greigg

[57] ABSTRACT

A device for damping vibrations of the holder of the cross-wound bobbin being driven frictionwise by the yarn guiding drum is provided with a spring (5) and a slidable pin (6) both placed within the hollow of the shaft (4) about which the holder (2) rotates. On the shaft (4) a stopper ring (7) is fixed immovably, abutting on the machine frame (8), and in the longer arm of the holder (2) a friction insert (9) is fitted. The spring (5) acting over the pin (6) on the lever (3) clamps the bobbin (1) in the holder arms (2), and shifts the holder to the left, pressing the holder arm with the friction insert (9) fitted therein down to the machine frame (8), and the friction force generated thereby damps the vibrations of the bobbin holder.

2 Claims, 1 Drawing Figure

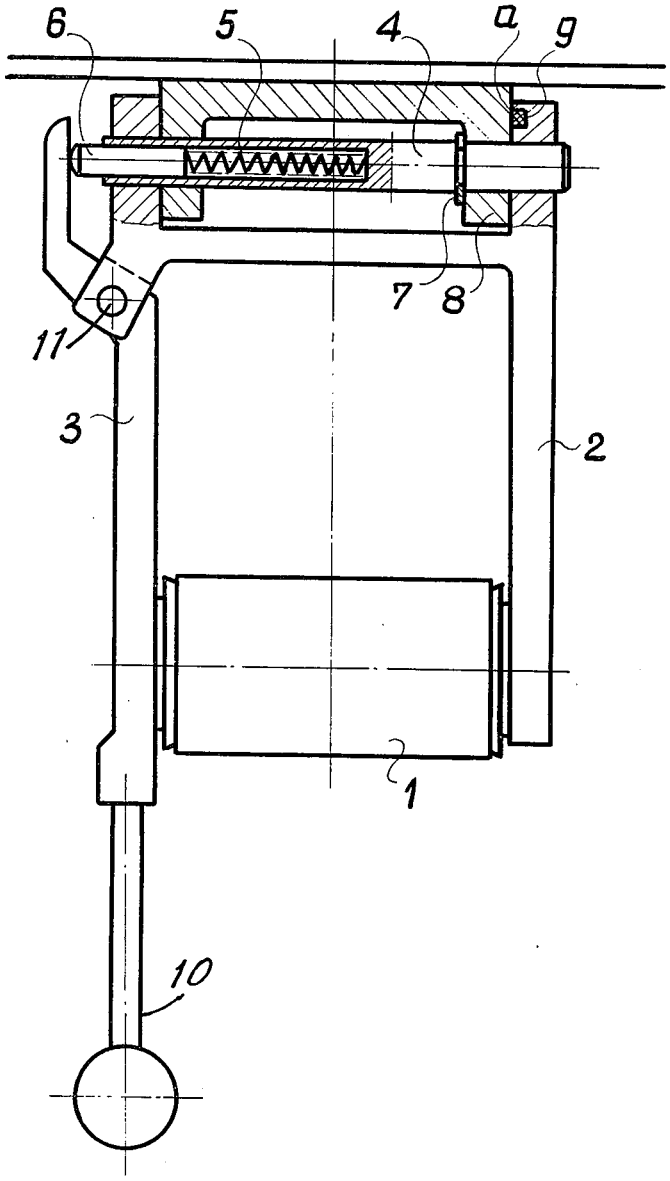
6
5
4
a
g
7
8
11
3
2
1
10

DEVICE FOR DAMPING VIBRATIONS OF THE BOBBIN HOLDER

BACKGROUND OF THE INVENTION

1. Field of the Invention

The invention relates to a device for damping vibrations of a bobbin holder in yarn cross-winding machines in which the bobbin is friction driven by a cylinder which guides the yarn or by a plain roller.

2. Description of the Prior Art

During winding of yarn onto bobbins by friction means that are driven by the thread drum guides, vibrations of the bobbins occur thus effecting an improper shape of the winding to be formed. Normally such vibrations increase with the diameter of the winding. In order to avoid such occurrences various types of pressing devices are employed in known machines and are arranged to press the bobbin down to the cylinder, thereby securing a compact winding, and simultaneously damping the vibrations of the bobbin.

The pressing device acting on the arm of the bobbin holder, known from the disclosure in the Polish Patent Specification No. 42,487, comprises two cooperating levers, one of which is provided with a guiding surface, the other being provided with a roller that is fitted on the end of the lever which rolls over the mentioned guiding surface. The levers are carried by the body of the bobbin holder which is fitted to the frame of the machine. To the free end of the lever which supports the guiding surface a pull spring is attached, the other end of which is secured to a pin fitted in the body of the holder. The bobbin held in arms of a swivel holder is clamped by a flat spring which acts on the holder arm. The vibrations of the holder are damped under the action of the friction force of the roller rolling over the guiding surface of the lever being pressed against the roller by the spring.

In said arrangement the force damping the vibrations is not constant, and it decreases as the diameter of the winding increases. Moreover the device is rather extended, as it comprises elements causing the pressing down of the bobbin to the cylinder, as well as elements clamping the bobbin in the arms of the holder.

Said disadvantages and inconveniences are eliminated by the device according to the present invention in which the same elements are utilized for clamping the bobbin in the holder, and for damping vibrations. Inside the shaft, a portion of which is tubular and upon which the bobbin holder is swingably supported, is seated a spring which acts on a slidable pin and urges it against a lever which forms one of the arms of the bobbin holder, its function being to cause clamping of the bobbin between that arm and the adjacent arm in the holder arms. The longer arm of the holder carries a friction insert, and, through the medium of the spring provided in the shaft, it is urged against the carrier thereby causing the friction force exerted to dampen the vibrations of the holder.

The device according to the invention is characterized by a simple and compact construction. Eliminating of the unnecessary elements which are known components of the hitherto applied arrangement reduces the weight of the device as well as consumption of materials. The constant pressure of the holder arm with the friction insert placed therein, independent of the diameter of the winding, provides a constant friction force damping the vibrations of the bobbin holder, said force being able to be adjusted.

DESCRIPTION OF DRAWING AND PREFERRED EMBODIMENT

The subject of the invention is shown by the way of an exemplary embodiment with reference to the accompanying drawing showing a general diagrammatic view.

The bobbin 1 is held between a rigid arm or holder 2 and a further arm 3 which is arranged in the form of a swivelable lever. The holder 2 is rotatably mounted on the shaft 4 provided with a hollow portion in which a spring 5 is positioned which in turn acts on the lever 3 by means of the slidable pin 6. On the shaft 4 the stopper ring 7 is immovably mounted and abuts the carrier or frame 8 of the machine and consequently prevents the shifting of the holder 2 to the right. The friction insert 9 is fitted in the longer arm of the holder 2 so as to be in contact point with the frame 8.

The spring 5 pre-loads the pin 6 against the lever 3 to clamp the bobbin 1 in the holder arm 2, and simultaneously shifts the entire holder 2 to the left. The friction force is generated on the surface *a* to dampen the vibrations of the holder 2. This force may be adjusted by controlling the strength of the spring 5, and by a suitable selection of the friction insert 9 which develops the necessary coefficient of friction, and by controlling the distance between the friction insert and the shaft 4.

Also, a handle 10, attached to the end of arm 3 remote from the slidable pin 6, permits the arm 3 to be manually rotated about the lever pin 11 carried by the holder 2, to load and unload bobbins from the holder 2.

What is claimed is:

1. A yarn cross winding machine comprising, in combination:

a. a friction driven bobbin having a winding surface area;

b. a machine frame member;

c. a shaft having an axis and supported by said machine frame member, said shaft having one end which defines a recess therein;

d. a bobbin holder supported by said shaft for pivotal and axial movement relative thereto, comprising first and second arms for swingably supporting said bobbin, wherein said second arm is one end of a lever pivotably mounted to said first arm about an axis extending perpendicularly to said axis of said shaft; and e. means for resiliently clamping said bobbin between said arms and for simultaneously urging a portion of said first arm against said machine frame member, thereby causing a friction generated force to dampen vibrations of said bobbin holder comprising:

a spring disposed within said recess, a pin, slidably disposed within said recess, having one end upon which a force is exerted by said spring, and an opposite end in sliding contact with an end of said lever opposite said end of said lever which also is said second arm, and a stopper ring immovably mounted on said shaft, which abuts against said machine frame member and prevents axial movement of said shaft by the force exerted by said spring upon said shaft.

2. A yarn cross winding machine according to claim 1, wherein said portion of said first arm urged against said machine frame member comprises a friction-producing insert carried by said first arm.

* * * * *